US005947002A

United States Patent [19]

Eitai et al.

[11] Patent Number: 5,947,002

[45] Date of Patent: Sep. 7, 1999

[54] VARIABLE CAPACITY WOBBLE PLATE COMPRESSOR

[75] Inventors: Kazuo Eitai, Higashimatsuyama; Minoru Kanaizuka; Hiroyuki Ishida, both of Kounan-machi, all of Japan

[73] Assignee: Zexel Corporation, Tokyo, Japan

[21] Appl. No.: 08/990,969

[22] Filed: Dec. 15, 1997

[30] Foreign Application Priority Data

Dec. 17, 1996 [JP] Japan ..... 8-353466

[51] Int. Cl.[6] ..... F01B 3/00

[52] U.S. Cl. ..... 92/71; 92/12.2; 91/505

[58] Field of Search ..... 92/12.2, 71; 91/504, 91/505; 417/222.1, 222.2, 269; 74/60

[56] References Cited

U.S. PATENT DOCUMENTS

| | | | |
|---|---|---|---|
| 2,532,254 | 11/1950 | Bouchard | 74/60 |
| 4,178,135 | 12/1979 | Roberts | 417/222.2 |
| 4,584,926 | 4/1986 | Beck, Jr. et al. | 91/505 |
| 5,425,303 | 6/1995 | Shimizu et al. | 92/71 |

FOREIGN PATENT DOCUMENTS

| | | | |
|---|---|---|---|
| 399242 | 10/1942 | France | 92/12.2 |

*Primary Examiner*—Thomas E. Denion
*Attorney, Agent, or Firm*—Frishauf, Holtz, Goodman, Langer & Chick, P.C.

[57] ABSTRACT

A variable capacity wobble plate compressor includes a drive shaft, a rotating member rigidly fitted on the drive shaft for rotation in unison with the drive shaft, a tilting rotating member mounted on the drive shaft in a slidable manner, and a pair of link members connecting the rotating member and the tilting rotating member to each other. The rotating member has one radial end portion thereof formed with a pair of link member-holding portions extending in parallel with each other. The pair of link members has one ends thereof pivotally connected to the pair of link member-holding portions by a first connecting member, and other ends thereof connected to the tilting rotating member by a second connecting member. The first connecting member is formed by a bolt, one of the pair of link member-holding portions being formed therethrough with an internal thread, another of the pair of link member-holding portions and the one ends of the link members being formed respectively with through holes, the bolt extending through the through holes of the another of the pair of link member-holding portions and the one ends of the link members and being screwed into the internal thread formed through the one of the pair of link member-holding portions.

1 Claim, 3 Drawing Sheets

VARIABLE CAPACITY WOBBLE PLATE COMPRESSOR

BACKGROUND OF THE INVENTION

1. Field of the Invention

This invention relates to a variable capacity wobble plate compressor.

2. Description of the Prior Art

A variable capacity wobble plate compressor includes a thrust flange rigidly fitted on a drive shaft, a drive hub mounted on the drive shaft via a hinge ball which is a slidable along the drive shaft, and a link arm connecting one radial end portion of the thrust flange and one radial end portion of the drive hub to each other.

The thrust flange, the drive hub, and the link arm form a linkage, which transmits torque of the drive shaft from the thrust flange to the drive hub via the link arm.

The link arm has one end thereof pivotally connected to the one radial end portion of the thrust flange by a front link pin, and the other end thereof pivotally connected to the one radial end portion of the drive hub by a link pin.

FIG. 1 shows construction of the linkage of the conventional variable capacity wobble plate compressor in detail in cross section.

A thrust flange 240 has one radial end portion thereof formed with a pair of arm-holding portions 245, 246 axially extending inward in parallel with each other.

The link arm 242 is comprised of a first link arm 242A arranged in a manner sandwiched between an inner surface of the arm-holding portion 245 and one side face of a protruding portion 247 of the drive hub 241, and a second link arm 242B arranged in a manner sandwiched between an inner surface of the arm-holding portion 246 and the other side face of the protruding portion 247 of the drive hub 241.

The link arm 242 is assembled with the thrust flange 240 by press-fitting the front link pin 243 in a direction indicated by arrow "a" via through holes 246*a*, 242*b*, 242*a*, and 245*a* which are formed through the arm-holding portion 246, the second link arm 242B, the first link arm 242A, and the arm-holding portion 245, respectively.

After the press-fitting of the front link pin 243 is completed, a retaining ring 243*a* is fitted on an end of the front link pin 243 so as to retain the pin 243.

However, in the variable capacity wobble plate compressor having the linkage constructed as above, when a clearance between the inner surface of the arm-holding portion 245 and the first link arm 242A and a clearance between the inner surface of the arm-holding portion 246 and the second link arm 242B are excessively large, large noise is produced due to vibrations caused by operation of the compressor, and further, for example, the root of the drive hub 241 can be broken due to impact load resulting from gaps produced between respective end portions of the arm-holding portions 245, 246 and the link arms 242A, 242B (lowered reliability of the compressor).

Inversely, when the clearance between the inner surface of the arm-holding portion 245 and the first link arm 242A and the clearance between the inner surface of the arm-holding portion 246 and the second link arm 242B are excessively small, the drive hub 241 cannot move smoothly, which results in degradation of controllability of the compressor.

To overcome these problems, it is required to hold constant the clearance between the inner surface of the arm-holding portion 245 and the first link arm 242A and the clearance between the inner surface of the arm-holding portion 246 and the second link arm 242B.

In the conventional linkage, however, the above-mentioned tolerances are so close compared with machining tolerances of the drive hub 241 and the thrust flange 240 that it is necessary to have a stock of tens of types of link arms which are different in thickness from each other and select from the stock a pair of link arms each having a thickness conforming to the above-mentioned clearances when each linkage is assembled.

Further, since the front link pin 243 is fitted in by press-fitting as described above, the distance between the inner surfaces of the arm-holding portions 245, 246 (and hence each of the above-mentioned clearance) is decreased. To overcome this problem, it is required to adjust the distance between the inner surfaces of the arm-holding portions 245, 246 after the press-fitting by applying a predetermined pressure to the press-fitted front link pin 243 in a direction (indicated by arrow "b") opposite to the press-fitting direction.

Moreover, a gap exists between the arm-holding portion 245 and the retaining ring 243*a*, so that when the compressor is operation, a force developed in a direction of increasing the distance between the opposed inner surfaces of the arm-holding portions 245, 246 can expand the distance between the arm-holding portions 245, 246 against frictional forces acting respectively between the arm-holding portions 245, 246 and the front link pin 243 to deform the thrust flange 240, which hinders reduction of noise due to vibrations and impairs reliability of the compressor.

SUMMARY OF THE INVENTION

It is an object of the invention to provide a variable capacity wobble plate compressor having a linkage which can be formed by using a link member having a predetermined thickness, and at the same time does not cause deformation of a rotating member, whereby it is possible to reduce noise produced by vibrations of the components of the linkage occurring when the compressor is in operation, enhance the reliability of the compressor, and decrease the number of man-hours required for the assembly of the linkage.

To attain the above object, the present invention provides a variable capacity wobble plate compressor including a drive shaft, a rotating member rigidly fitted on the drive shaft for rotation in unison with the drive shaft, a tilting rotating member mounted on the drive shaft in a slidable manner, and a pair of link members connecting the rotating member and the tilting rotating member to each other, the rotating member having one radial end portion thereof formed with a pair of link member-holding portions extending in parallel with each other, the pair of link members having one ends thereof pivotally connected to the pair of link member-holding portions by a first connecting member, and other ends thereof connected to the tilting rotating member by a second connecting member.

The variable capacity wobble plate compressor is characterized in that the first connecting member is formed by a bolt, one of the pair of link member-holding portions being formed therethrough with an internal thread, another of the pair of link member-holding portions and the one ends of the link members being formed respectively with through holes, the bolt extending through the through holes of the another of the pair of link member-holding portions and the one ends of the link members and being screwed into the internal thread formed through the one of the pair of link member-holding portions.

According to the variable capacity wobble plate compressor of the invention, it is possible to assemble the rotating member and the link members by fastening the bolt, with predetermined clearances held therebetween, and at the same time prevent the rotating member from being deformed during operation of the compressor.

The above and other objects, features and advantages of the present invention will become more apparent from the following detailed description taken in conjunction with accompanying drawings.

DETAILED DESCRIPTION OF THE PREFERRED EMBODIMENT

The invention will now be described in detail with reference to drawings showing a preferred embodiment thereof.

Figure 1:
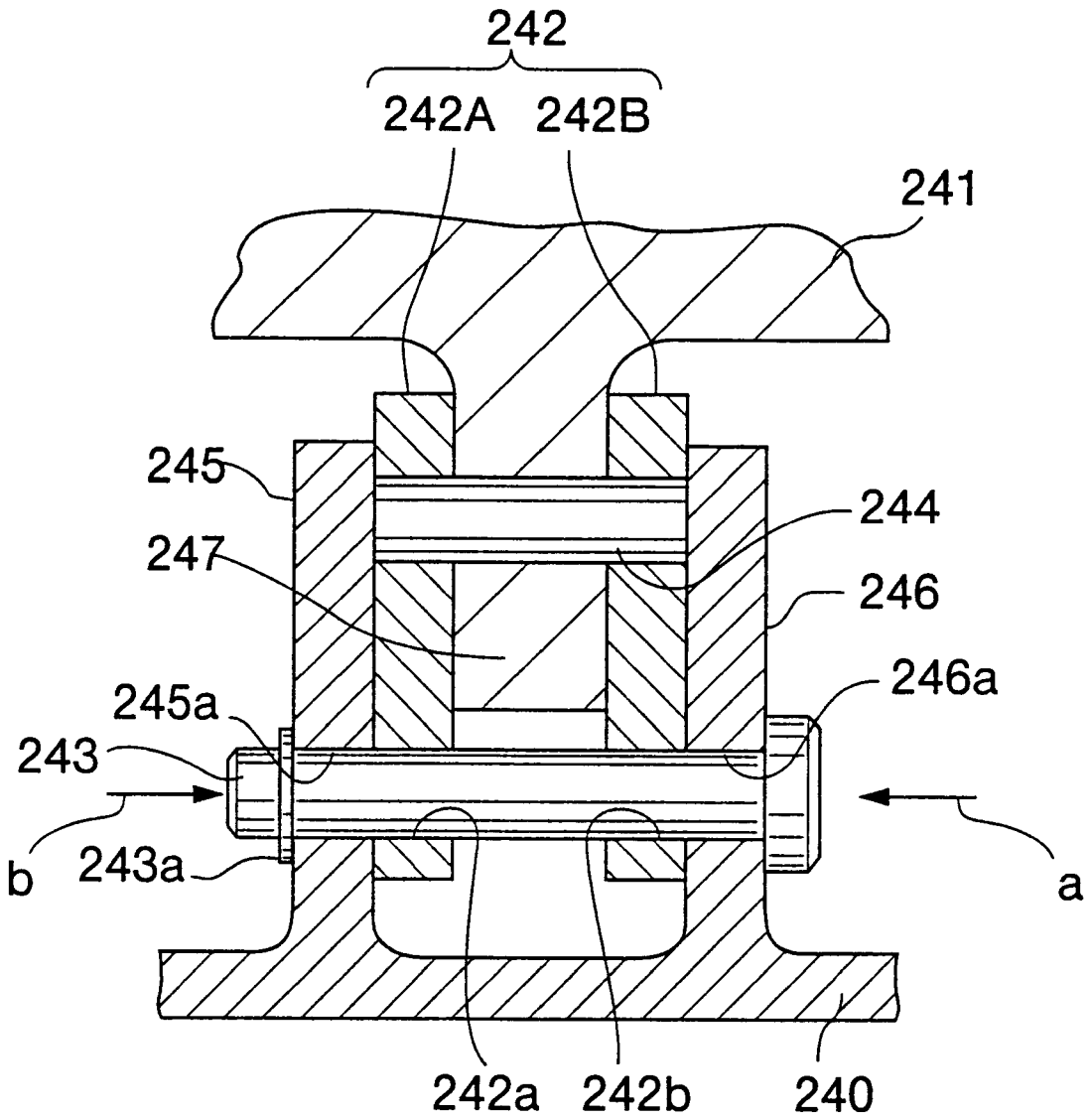
FIG.1 PRIOR ART
FIG. 1 is a cross-sectional view showing a linkage of a conventional variable capacity wobble plate compressor.
Figure 2:
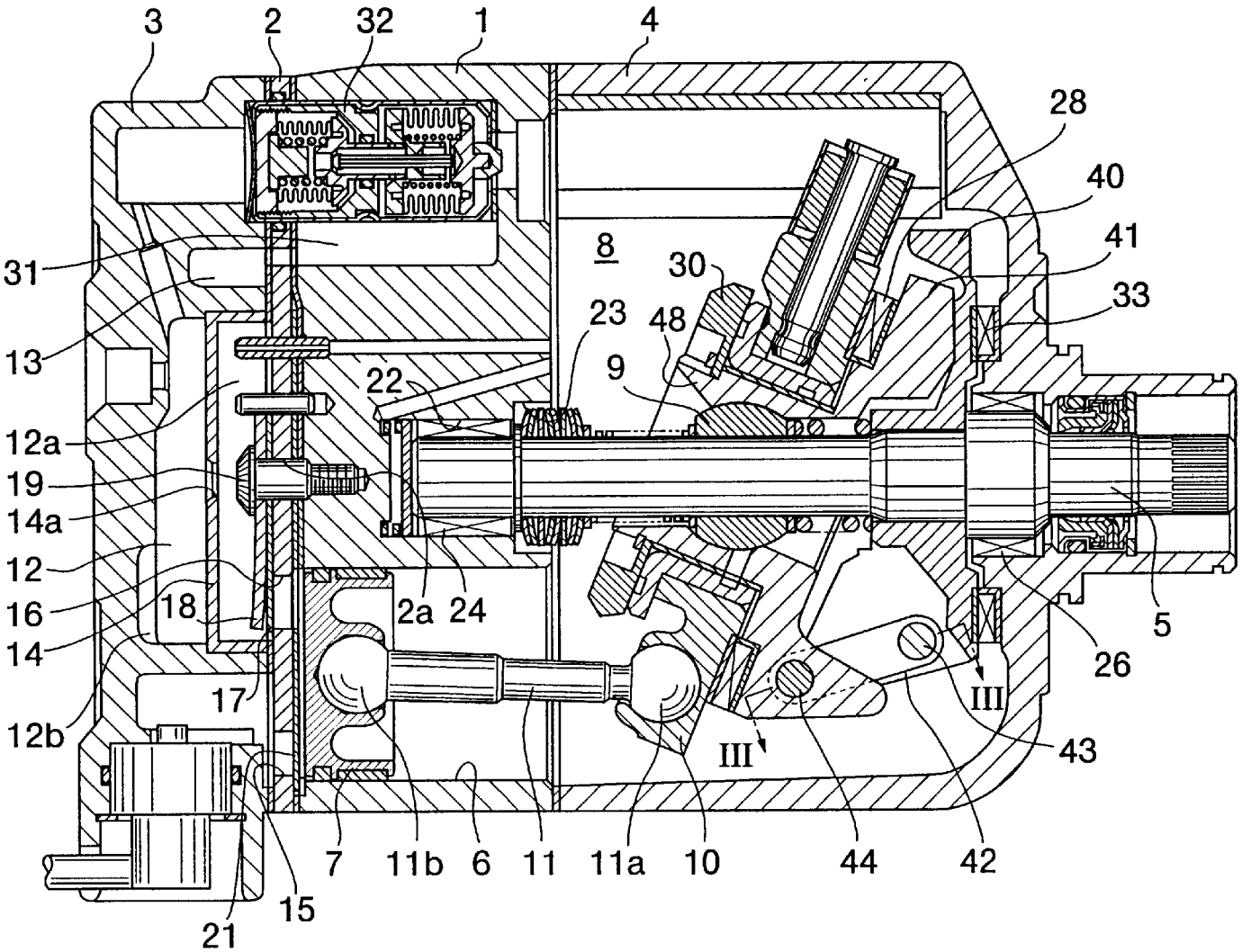
FIG. 2 is a cross-sectional view showing the whole arrangement of a variable capacity wobble plate compressor according to an embodiment of the invention.

Referring first to FIG. 2, there is shown the whole arrangement of a variable capacity wobble plate compressor according to an embodiment of the invention.

The compressor includes a cylinder block 1, a rear head 3 rigidly fixed to one end face of the cylinder block 1 via a valve plate 2, and a front head 4 secured to the other end face of the cylinder block 1.

The cylinder block 1 is formed with a plurality of cylinder bores 6 axially extending therethrough at predetermined circumferential intervals about a drive shaft 5. Each cylinder bore 6 has a piston 7 slidably received therein.

The front head 4 has a crankcase 8 formed therein, in which a wobble plate 10 is received for axial wobbling motion about a hinge ball 9 loosely or slidably fitted on the drive shaft 5, in a manner interlocked with rotation of the drive shaft 5.

The wobble plate 10 has each piston 7 connected thereto by a connecting rod 11, and the piston 7 moves in the cylinder bore 6 in a reciprocating manner according to the axial wobbling motion of the wobble plate 10. The degree of inclination of the wobble plate 10 varies with pressure within the crankcase 8.

One ball-shaped end 11*a* of the connecting rod 11 is slidably coupled to the wobble plate 10, while the other ball-shaped end 11*b* of the same is coupled to the piston 7.

The rear head 3 is formed therein with a discharge chamber 12 and a suction chamber 13 formed around the discharge chamber 12. The discharge chamber 12 is divided by a partition wall 14 into discharge spaces 12*a*, 12*b* which communicate with each other via a restriction hole 14*a* formed through the partition wall 14.

The valve plate 2 is formed therethrough with refrigerant outlet ports 16 for each communicating between a corresponding one of the cylinder bores 6 and the discharge space 12*a*, and refrigerant inlet ports 15 for each communicating between a corresponding one of the cylinder bores 6 with the suction chamber 13.

Refrigerant outlet ports 16 are opened and closed by discharge valves 17, respectively, which are fixed by a bolt 19 to a rear-side end face of the valve plate 2 together with respective valve stoppers 18 associated therewith. The bolt 19 is screwed into a rear-side end face of the cylinder block 1 via a central hole 2*a* formed through the valve plate 2.

On the other hand, refrigerant inlet ports 15 are opened and closed by suction valves 21, respectively, which are arranged between the valve plate 2 and the cylinder block 1.

A small diameter hole 22 and a large diameter hole 23 continuous therefrom are axially formed in the center of the cylinder block 1. A radial bearing 24 is received in the small diameter hole 22. The radial bearing 24 rotatably supports a rear-side end of the drive shaft 5, while a radial bearing 26 arranged within the front head 4 rotatably supports a front-side end of the drive shaft 5.

Further, the cylinder block 1 is formed therein with a communication passage 31 for communicating between the suction chamber 13 and the crankcase 8. A pressure control valve 32 is arranged in an intermediate portion of the communication passage 31 for controlling the pressure within the suction chamber 13 and the pressure within the crankcase 8.

The drive shaft 5 has a thrust flange (rotating member) 40 rigidly fitted on the front-side end thereof. A drive hub (tilting rotating member) 41 is mounted on the drive shaft 5 via the hinge ball 9 at a location axially inward of the thrust flange 40.

The thrust flange 40 and the drive hub 41 are connected to each other by a link arm (link member) 42 to form a linkage which transmits torque of the drive shaft 5 from the thrust flange 40 to the drive hub 41 via the link arm 42.

The link arm 42 has one end thereof pivotally connected to one radial end portion of the thrust flange 40 by a front link pin (first connecting member) 43 and the other end thereof pivotally connected to one radial end portion of the drive hub 41 by a link pin (second connecting member) 44.

Further, a thrust bearing 33 is arranged between the thrust flange 40 and the front head 4, a balance weight 30 is fitted on a boss 48 of the drive hub 41, and a thrust bearing 28 is arranged between the drive hub 41 and the wobble plate 10.

Figure 3:
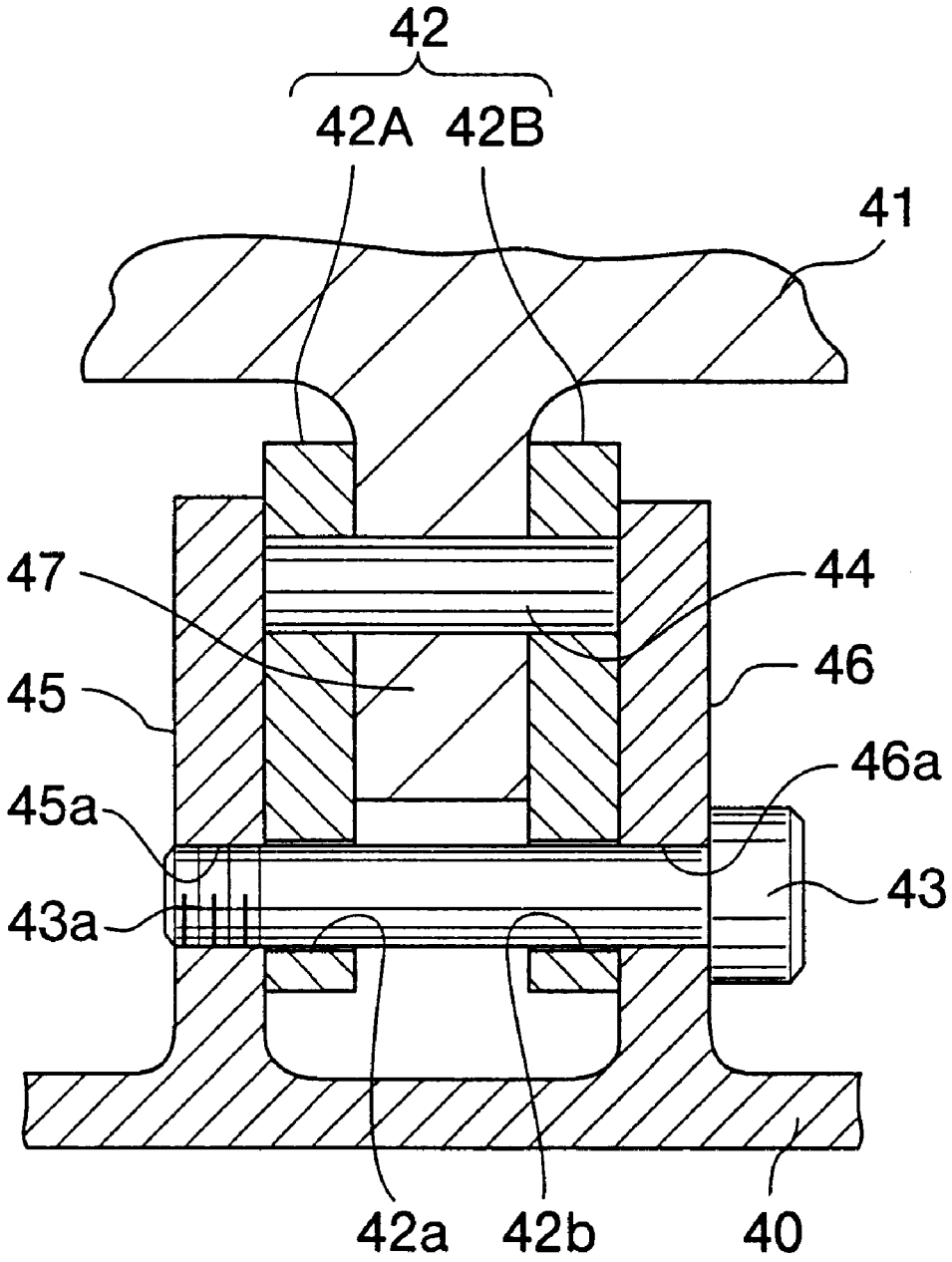
FIG. 3 is a sectional view showing a linkage of the variable capacity wobble plate compressor according to the embodiment, taken on line III—III of FIG. 2.

FIG. 3 is a sectional view of the linkage taken on line III—III of FIG. 2.

The thrust flange 40 has the one radial end portion thereof integrally formed with a pair of arm-holding portions, i.e. one arm-holding portion 45 and the other arm-holding portion 46, which axially extend therefrom inward in parallel with each other.

The link arm 42 is comprised of a first link arm 42A arranged in a manner sandwiched between an inner surface of the one arm-holding portion 45 and one side face of a protruding portion 47 of the drive hub 41, and a second link arm 42B arranged in a manner sandwiched between an inner surface of the other arm-holding portion 46 and the other side face of the protruding portion 47 of the drive hub 41.

The one arm-holding portion 45 is formed therethrough with an internal thread 45*a*. The front link pin 43 is formed by a bolt which has an end portion thereof formed with an external thread 43*a* to be screwed into the internal thread 45*a* formed through the one arm-holding portion 45.

The front link pin 43 is inserted from an outer surface of the other arm-holding portion 46 through through holes 46*a*, 42*b*, and 42*a* formed through the other arm-holding portion 46, the second link arm 42B, and the first link arm 42A, respectively, and fastened by screwing the external thread 43*a* thereof into the internal thread 45*a* formed through the one arm-holding portion 45 at a predetermined fastening torque.

According to the embodiment, the front link pin 43 is mounted not by press-fitting but by fastening the bolt (front link pin 43). Therefore, the thrust flange 40 no longer suffers from deformation caused by press-fitting, and variation in a clearance between the inner surface of the one arm-holding portion 45 and the first link arm 42A and a clearance between the inner surface of the arm-holding portion 46 and the second link arm 42B is reduced (in other words, these clearances can be easily controlled). As a result, it is no longer required to have a stock of tens of kinds of link arms different in thickness from each other in assembling linkages, which has been conventionally in practice, but it is sufficient to have a stock of link arms of a single kind.

Further, when the linkage is assembled, it is possible to secure a fixed distance between the opposed inner surfaces of the pair of arm-holding portions 45, 46 by controlling an axial force generated by fastening of the bolt (front link pin 43), and hence properly set the clearance between the inner surface of the one arm-holding portion 45 and the first link arm 42A and the clearance between the inner surface of the arm-holding portion 46 and the second link arm 42B. Therefore, it is possible to dispense with the operation conventionally carried out after the press-fitting of the front link pin 243, as described hereinbefore, in which a predetermined force acting in a direction opposite to the press-fitting direction is applied to the press-fitted front link pin 243 for adjustment of the distance between the arm-holding portions 245, 246.

Moreover, according to the present embodiment, once the bolt has been fastened at the predetermined fastening torque, the bolt is rigidly fixed by a force acting between the external thread 43*a* of the bolt and the internal thread 45*a* of the one arm-holding portion 45 and a force acting between the head of the bolt and the other arm-holding portion 46. Therefore, it is possible to prevent an increase in the distance between the root portions of the arm-holding portions 45, 46 which conventionally occurs when the compressor is in operation, and at the same time dispense with the retaining ring 243*a* conventionally used for retaining the front link pin 243.

Further, since the root portions of the arm-holding portions 45, 46 of the thrust flange 40 are firmly fixed in a lateral direction by the bolt (front link pin 43), when the compressor is in operation, deformation occurs only to portions of the arm-holding portions 45, 46 between the ends of the arm-holding portions 45, 46 and the bolt, so that the degree of expansion of the arm-holding portions 45, 46 can be reduced very much compared with those of the prior art. This makes it possible to prevent the drive hub 41 from being broken due to gaps produced between the arm-holding portions 45, 46 and the link arms 42A, 42B, as well as noises from being generated through vibrations of the linkage.

Still further, according to the present embodiment, it is possible to ensure smooth motion of the drive hub 41 by controlling the fastening torque of the front link pin 43 within a predetermined range (enhanced controllability of the compressor).

It is further understood by those skilled in the art that the foregoing is the preferred embodiment of the invention, and that various changes and modification may be made without departing from the spirit and scope thereof.

What is claimed is:

1. In a variable capacity wobble plate compressor including a drive shaft, a rotating member rigidly fitted on said drive shaft for rotation in unison with said drive shaft, a tilting rotating member mounted on said drive shaft in a slidable manner, and a pair of link members connecting said rotating member and said tilting rotating member to each other, said rotating member having one radial end portion thereof formed with a pair of link member-holding portions extending in parallel with each other, said pair of link members having one ends thereof pivotally connected to said pair of link member-holding portions by a first connecting member, and other ends thereof connected to said tilting rotating member by a second connecting member, the improvement wherein said first connecting member is formed by a bolt, one of said pair of link member-holding portions being formed therethrough with an internal thread, another of said pair of link member-holding portions and said one ends of said link members being formed respectively with through holes, said bolt extending through said through holes of said another of said pair of link member-holding portions and said one ends of said link members and being screwed into said internal thread formed through said one of said pair of link member-holding portions.

* * * * *